United States Patent [19]

Gawlick et al.

[11] 4,008,665

[45] Feb. 22, 1977

[54] TRAINING AMMUNITION

[75] Inventors: Heinz Gawlick; Rudolf Stahlmann; Ernst Jensen, all of Furth, Germany

[73] Assignee: Dynamit Nobel Aktiengesellschaft, Germany

[22] Filed: Aug. 28, 1974

[21] Appl. No.: 501,357

[30] Foreign Application Priority Data

Sept. 6, 1973 Germany ..... 2344939

[52] U.S. Cl. ..... 102/41; 102/92.7; 102/93

[51] Int. Cl.[2] ..... F42B 9/20

[58] Field of Search ..... 102/41, 60, 66, 92.7, 102/93

[56] References Cited

UNITED STATES PATENTS

| | | | |
|---|---|---|---|
| 1,094,402 | 4/1914 | Keen | 102/41 |
| 2,911,911 | 11/1959 | White | 102/93 X |
| 3,127,836 | 4/1964 | Silva | 102/41 |
| 3,242,865 | 3/1966 | Jungermann et al. | 102/41 |
| 3,291,048 | 12/1966 | Lubbers | 102/41 |
| 3,348,484 | 10/1967 | Grandy | 102/66 |
| 3,732,821 | 5/1973 | Royer | 102/92.7 |

*Primary Examiner*—Verlin R. Pendegrass
*Attorney, Agent, or Firm*—Craig & Antonelli

[57] ABSTRACT

Training ammunition including a projectile disposed in a cartridge case, the projectile having a rear portion with an axially extending recess and a charge disposed therein, a cover cap extending over the rear of the projectile in a formfitting manner, and at least one obturation member disposed proximate to the cover cap, the cover cap having an outer diameter at least equal to and/or slightly greater than the caliber of the projectile.

35 Claims, 7 Drawing Figures

TRAINING AMMUNITION

Figure 1:
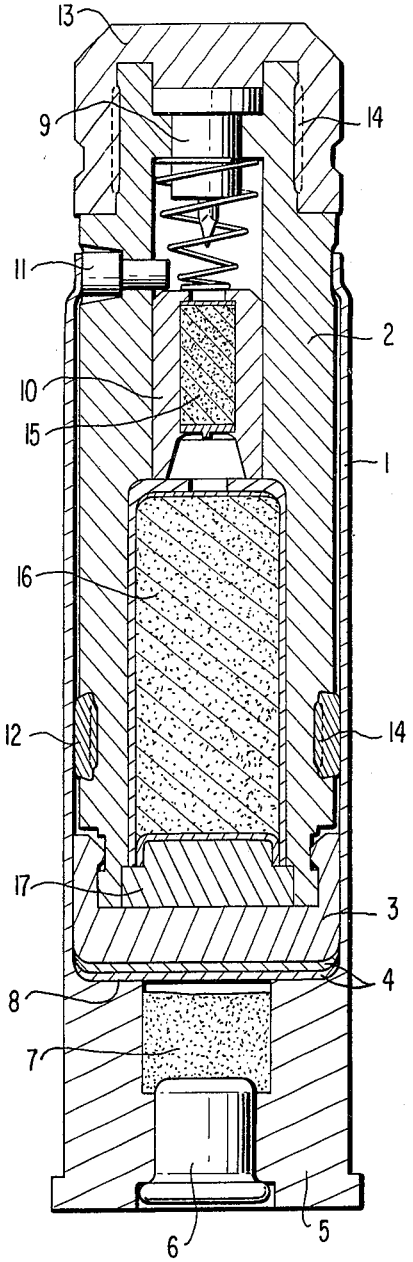

The present invention relates to training or practice ammunition having a projectile disposed in a cartridge case, and including an axial recess emanating from the rear end of the projectile, with a flare charge, smoke charge, or the like inserted therein, and a cover cap preferably extending over the rear end of the projectile in a formfitting manner, as well as an additional obturation member.

The training ammunition has a projectile caliber which is smaller than the live ammunition and is fired from correspondingly subcaliber liner barrels. The ammunition may have the same range as live ammunition, but generally has a shorter range. Additionally, the training ammunition has a smaller amount of propellant charge than the corresponding live ammunition. One example for such a training ammunition is described in DOS (German Unexamined Laid-Open Application) No. 1,428,678, according to which the projectile is provided with an axial recess starting at the rear end, wherein a percussion fuze, a smoke charge and a flare charge are arranged in succession and are retained by means of a cover cap attached in a form and/or friction fit at the rear end of the projectile. The outer diameter of this cover cap is smaller than the caliber of the practice projectile.

The firing of this training ammunition becomes the more problematic, the smaller the amount of propellant charge in that, due to the manufacturing tolerances unavoidable during mass production, it is impossible to obtain a uniform and/or complete seal between the training projectile and the liner barrel. The consequence is not only that amounts of propellant gas which are different from one shot to the next flow unused past the projectile, but also that these amounts of propellant gas exert fluctuating radial interfering forces on the projectile, the effect of which is the larger, the lower the projectile velocity in the liner barrel. Thus, the range and the target accuracy of the training projectile are subject to undue fluctuations. As can readily be seen, these disadvantageous effects become increasingly grave with increasingly smaller amounts of propellant charge.

Up to a certain extent, it has been possible to eliminate these disadvantages by providing a sabot or adapter disk behind the cover cap of the training projectile, fashioned as at least one disk-shaped element. This additional obturation member is produced from a material such as, for example, cardboard, felt, a thermoplastic synthetic resin, such as polyethylene or polypropylene, lead, or also soft copper, which material hugs the barrel wall during firing and thus accomplishes an improved seal.

However, as found in practice, this solution is not satisfactory, either, in case of very small amounts of propellant charge, since this solution does not make it possible to flawlessly reproduce the external ballistics of the training projectile. These difficulties exist, for example, in case of a training ammunition for shell-firing rifles, also called grenade launchers, which ammunition contains, at a maximum firing range of about 400 m., only 0.10 g. of propellant powder, or in case of an antitank training ammunition with 0.35 g. of propellant powder and a maximum firing range of about 1,500 m. With these very small amounts of propellant charges and correspondingly relatively small propellant gas pressures, the effect of the unavoidable manufacturing tolerances was so great that the firing results were unsatisfactory, due to the strong dispersions. Even a further, considerable enlargement of the outer diameter of the obturating sabot did not bring any satisfactory results.

It is therefore an object of the present invention to avoid, in a training ammunition of the type described in the foregoing, the disadvantages set forth above which become increasingly grave with reduced propellant charge weights.

In accordance with the present invention, the disadvantages can be overcome by providing that the cover cap is, in its outer diameter, identical or at most only a little larger than the projectile caliber, and that the obturation member is fashioned as a conventional sabot or as an annular sealing lip integrally formed at the cover cap and extending toward the rear and/or as at least one sealing ring. The cover cap, produced from a thermoplastic synthetic resin, such as, for example, polypropylene, polyethylene, or polyamide, is, in its outer diameter, at most about 5%, but preferably only by about 3% larger than the caliber of the projectile, unless it is already initially produced with the same dimensions. The limitations in the outer diameter result from the consideration that the cartridge case of the training ammunition is, for economical reasons, generally manufactured from aluminum and/or an aluminum alloy and thus is relatively readily deformable, so that in case of a cover cap having a larger outer diameter there would be the danger that a disadvantageous expansion of the cartridge case occurs during the testing of the ammunition which, particularly in case of automatic firearms, would make the flawless functioning of the ammunition questionable.

It has thus been possible to reduce the dispersions, even in case of very small quantities of propellant powder, to such an extent that the practical requirements are met without fault within the very broad temperature range of −20° to +40° C. This result was surprising, inasmuch as the cover cap which is produced, for example, by an injection molding process, does not exhibit an accurate cylindrical shape due to inherent stresses, but rather is deformed to a greater or lesser extent in the axial and radial directions, and also the actual projectile body proper as well as the liner barrel have dimensional deviations from the standard, so that in view of the fact that a sabot considerably increased in its outer diameter was found to be unsuccessful, no improved results could be expected from a cover cap of equal caliber or of an only slightly larger dimension. The fact that an improved seal and thus also an improved guidance in the barrel has thereby been obtained, after all, is the more astonishing since the cover cap, in the temperature range of from −20° C. to +40° C., has an entirely different thermal expansion characteristic than the projectile and the liner barrel.

A prerequisite to achieve this success is that —as indicated above— the cover cap of equal caliber or of only a slightly larger size is provided in conjunction with the conventional, separate sabot or with an annular sealing lip integrally formed therewith. The sabot as well as the sealing lip can, in the not yet installed condition, be considerably larger in the outer diameter than the projectile caliber, namely, depending on the elasticity of the materials employed, up to about 20%, since, during encasing in the cartridge, these materials due to their geometrical configuration sealingly engage the inner wall and/or the bottom piece of the cartridge case, whereby the danger of an undue widening of the case becomes considerably lesser. In place of the sabot or the sealing lip and/or in addition thereto, it is also possible to provide at least one sealing ring. This sealing ring is disposed preferably in the most rearward position in the region of the cover cap in order to prevent the gas leakage in the proximity of the rear end of the projectile, so that the radial effects of the propellant gases on the projectile, undesirable in view of the guidance within the barrel, are kept to a minimum. However, it is also possible to arrange the sealing ring also in the body of the projectile proper. The sealing ring, manufactured of a sufficiently readily deformable material, such as natural or synthetic rubber, thermoplastic synthetic resin such as polyethylene, polypropylene, etc., is, in turn, to be adapted in its external dimensions, together with the annular recess in the cover cap receiving the ring, or in the actual body of the projectile, so that no undue widening of the cartridge case takes place during testing. Depending on the requirements, it is also possible to arrange two or more such sealing rings in succession.

The respectively existing, particular conditions govern whether, in an individual case, the at least one sealing ring is provided in place of the sabot or the sealing lip and/or in addition thereto. In general, it can be stated that, for reasons of manufacturing technique, the integral formation of cover cap and sealing lip will be preferred, whereas the multipartite design with cover cap and sabot and/or sealing ring offers the possibility of using differing materials, so that it may be possible in certain cases to better adapt to the respective requirements.

In an embodiment of the present invention, with the use of a cover cap with annular sealing lip, the provision is made that the cover cap has a rearwardly extending supporting element, preferably a central, rearwardly tapering extension, for defined contact with a corresponding shoulder of the cartridge case. This supporting element, which could, for example, also be formed as an annular-cylindrical projection or as several separate, pin-shaped elements, makes it possible in a very simple manner during the encasing of the components to introduce and arrange the projectile in the cartridge case in a definite manner, if the sealing lip due to its flexibility does not offer a sufficiently accurate support.

The target accuracy attainable depends — as mentioned hereinabove — not only on the seal with respect to the propellant gases, but also on a maximally secure guidance in the barrel. Such guidance should be the more secure, the lower the velocity of the projectile in the barrel, and/or under otherwise identical conditions, the smaller the amount of propellant charge. Therefore, it is of considerable importance also for the training ammunition of this invention to make the guidance in the barrel maximally satisfactory. Consequently, in addition to the improved seal as mentioned above for this purpose, a further feature of this invention is the equipping of the projectile at the front end with a cover hood held by form fit and effective as a guidance within the barrel of the weapon. The tip of the projectile proper is thus fashioned as a guide element, so that a maximum guiding length is obtained together with the rear cover cap, which latter likewise provides a certain guidance. The cover hood can be manufactured, for example, of lead, copper, or sintered-powder metal, and can be pressed onto the front end of the projectile body. However, Teflon or another suitable synthetic resin can also be employed, the strength of which is sufficient to exclude also in case of spin-stabilized training projectiles, during passage through the barrel, any twisting between the projectile body and the cover hood and/or a cutting apart of the cover hood at the edges between the grooves and lands of the barrel.

Moreover, according to the present invention the front cover hood affords the additional possibility of maintaining, when using a percussion fuze, the firing pin thereof between the front end of the projectile and the cover hood. The firing pin can then be inserted by frictional fit from the front into the body of the projectile, in a manner which is very simple from the viewpoint of manufacturing technology, and can be securely fixed in position with the cover hood extending over the pin.

Further details and embodiments of the present invention will become apparent from the following specification when read with reference to the drawings in which:

FIG. 1 illustrates in a longitudinal sectional view training ammunition having a projectile in accordance with the present invention; and FIGS. 2–7 illustrate partial views of respective different embodiments of the rear of the projectile in accordance with the present invention.

Referring now to the drawings wherein the reference numerals are utilized to designate like parts throughout the several views, there is shown in FIG. 1 a training cartridge which is suitable, for example, for grenade launchers. This cartridge has, within a cartridge case 1 extruded from aluminum, a training projectile 2 provided at the rear end with a plastic cover cap 3, flushly attached thereto, and with two disk-shaped obturation members effective as a sabot 4. A conventional primer element 6, shown in elevational view, is inserted in a bottom piece 5 of the cartridge case 1, which primer serves for igniting the propellant charge 7 disposed in front thereof. The projectile 2 is supported on a shoulder 8 of the cartridge case 1. Since the muzzle velocity of the projectile, due to the very small amount of propellant charge, for example 0.1 g., is below about 70 m./sec., the projectile is equipped with a percussion fuze according to DOS No. 1,578,457 with a fixedly arranged front firing pin 9, shown in elevational view, an axially displaceable primer charge tube 10, and a lateral locking pin 11. In order to ensure the flawless ejection of the locking pin 11 after leaving the barrel, the projectile is manufactured from a material of larger strength, such as brass or steel and provided, for guidance within the barrel, with a rear guide strap 12 and a frontal cover hood 13, both being of lead. In order to ensure a satisfactory spin transmission, the projectile is conventionally provided with knurled portions 14 engaged by the guide band 12 and the cover hood 13. Upon impingement of the projectile in the target, the primer charge tube 10 is shifted toward the primer pin 9, securely held by means of the pressed-on cover hood 13, and the charge 15 disposed in the tube is ignited, this charge, in turn, ignites a smoke charge 16 disposed behind the charge 15. Due to the gas evolving from the smoke charge, the rear cover cap 3 and the spacer disk 17 are dropped, so that the smoke gases can exit and result in the desired marking of the target.

The cover cap 3 is connected by a form or flush fit with the rear of the projectile, to obtain an improved seal of the smoke charge 16, so that the latter can in no manner be ignited prematurely by propellant gases laterally flowing around the rear of the projectile during firing. However, it is also possible, of course, to mount the cover cap 3 basically merely by a frictional connection, especially if an additional flare charge is also provided, as shown in DOS No. 1,428,678, which is already ignited upon firing. In this case, the sabot 4, the cover cap 3, and the intermediate disk 17 must, of course, be formed with central perforations and/or with correspondingly minor wall thicknesses in the central zone, so that the illuminating flare charge can be satisfactorily ignited by the propellant gases.

Figure 2:
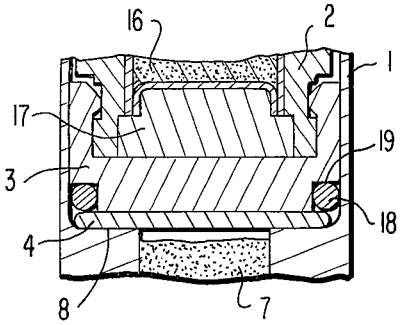
Figure 3:
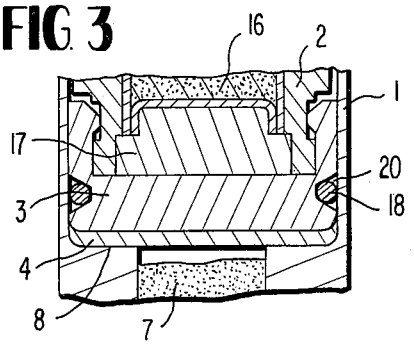
Figure 4:
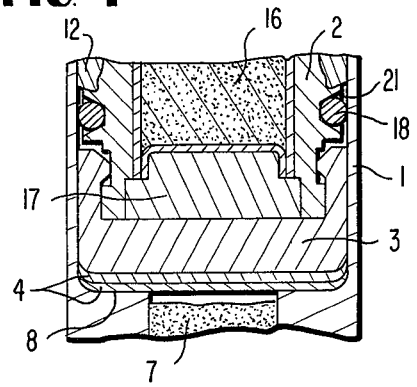

In the modification shown in FIG. 2, a sealing ring 18 is provided in addition to the sabot 4, which sabot is in this case only fashioned as a disk-shaped obturation member. The sealing ring is disposed in an annular recess 19 at the rear end of the cover cap 3, while, in the embodiment of FIG. 3, the sealing ring is arranged in the annular groove 20 and, according to the embodiment of FIG. 4, is disposed in the projectile body proper, in a groove 21. Additionally in FIG. 4, the sabot is in the form of two disk-shaped obturation members.

Figure 5:
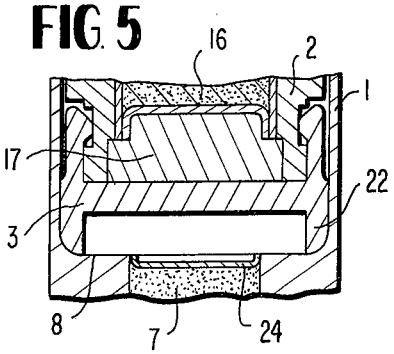
Figure 6:
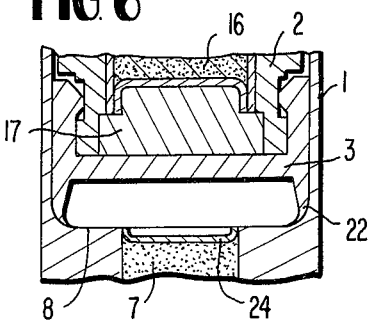
Figure 7:
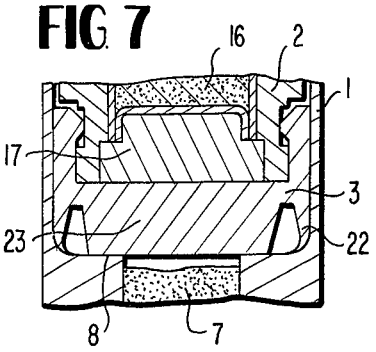

FIG. 5 shows a cover cap 3 with an annular sealing lip 22 extending rearwardly. The cover cap 3 has an outer diameter equal to or only slightly larger than the caliber of the projectile only in the rear zone of the cover cap. The sealing lip 22 tapers to only a relatively slight extent toward its free end. In contrast thereto, the sealing lip 22 shown in the embodiments of FIGS. 6 and 7 is more strongly tapered, and the cover cap 3 is formed without an external shoulder. According to FIG. 7, the cover cap 3 is furthermore provided with the central, rearwardly tapering extension 23, by way of which the projectile 2 rests on the shoulder 8 of the cartridge case 1. With a view toward a defined disposition of the propellant charge 7, the embodiments of FIGS. 5 and 6 include additionally a thin cover member 24 made of paper, a synthetic resin, or the like.

Obviously, many modifications and variations of the present invention are possible in the light of the above teachings. It should therefore be understood that within the scope of the appended claims, the invention may be practiced otherwise than as specifically described.

What is claimed is:

1. Training ammunition comprising a projectile disposed in a cartridge case for impingement on a target, said projectile having a rear portion with an axially extending recess and charge means disposed therein, cover cap means for obtaining a substantially uniform and complete seal between a training projectile utilizing small amounts of propellant charge relative to corresponding live ammunition and a barrel means through which it is fired to thereby aid the external ballistics of said projectile, said cover cap means extending over the rear portion of said projectile in a formfitting manner, and obturation means disposed proximate to said cover cap means, said cover cap means having an outer diameter at least equal to the caliber of said projectile.

2. Training ammunition according to claim 1, wherein said cover cap means has an outer diameter equal to the caliber of said projectile.

3. Training ammunition according to claim 1, wherein said cover cap means has an outer diameter slightly greater than the caliber of said projectile.

4. Training ammunition according to claim 3, wherein said cover cap means has an outer diameter greater than zero and less than 5% larger than the caliber of said projectile.

5. Training ammunition according to claim 4, wherein said cover cap means has an outer diameter 3% larger than the caliber of said projectile.

6. Training ammunition according to claim 1, wherein said obturation means includes at least one disk-like member disposed behind said cover cap means.

7. Training ammunition according to claim 1, wherein said obturation means includes an annular sealing lip member integrally formed with said cover cap means and extending toward the rear of said cartridge case.

8. Training ammunition according to claim 1, wherein said obturation means includes at least one sealing ring member proximate to said cover cap means.

9. Training ammunition according to claim 6, wherein said obturation means further includes at least one sealing ring member disposed proximate to said cover cap means.

10. Training ammunition according to claim 9, wherein said cover cap means is provided with an annular groove for receiving said at least one sealing ring member therein.

11. Training ammunition according to claim 9, wherein said projectile is provided with an annular groove in the region of the rear end thereof for receiving said at least one sealing ring member therein.

12. Training ammunition according to claim 1, wherein said cover cap means includes a rearwardly extending support member for contacting a shoulder portion of said cartridge case.

13. Training ammunition according to claim 12, wherein said rearwardly extending support member is a centrally disposed extension member tapering toward the rear.

14. Training ammunition according to claim 13, wherein said obturation means includes an annular sealing lip member integrally formed with said cover cap means and extending toward the rear.

15. Training ammunition according to claim 1, further comprising cover hood means provided at the front end of said projectile for guiding said projectile within the barrel of a weapon.

16. Training ammunition according to claim 15, wherein said cover hood means frictionally engages the front end of said projectile.

17. Training ammunition according to claim 15, wherein said projectile is provided with a percussion fuze disposed therein and a primer pin for the percussion fuze is maintained in the region of the front end of said projectile by said cover hood means.

18. Training ammunition according to claim 17, wherein said projectile is provided with an axially extending recess at the front end thereof and having said primer pin disposed therein, said cover hood means maintaining said primer pin within the recess in the front end of said projectile.

19. Training ammunition according to claim 15, wherein said obturation means includes at least one disk-like member disposed behind said cover cap means.

20. Training ammunition according to claim 17, wherein said obturation means further includes at least one sealing ring member disposed proximate to said cover cap means.

21. Training ammunition according to claim 20, wherein said projectile is provided with a percussion fuze disposed therein and a primer pin for the percussion fuze is maintained in the region of the front end of said projectile by said cover hood means.

22. Training ammunition according to claim 21, wherein said projectile is provided with an axially extending recess at the front end thereof and having said primer pin disposed therein, said cover hood means maintaining said primer pin within the recess in the front end of said projectile.

23. Training ammunition according to claim 22, wherein said cover cap means is provided with an annular groove for receiving said at least one sealing ring member therein.

24. Training ammunition according to claim 22, wherein said projectile is provided with an annular groove in the region of the rear end thereof for receiving said at least one sealing ring member therein.

25. Training ammunition according to claim 15, wherein said obturation means includes an annular sealing lip member integrally formed with said cover cap means and extending toward the rear of said cartridge case.

26. Training ammunition according to claim 25, wherein said cover cap means includes a rearwardly extending support member for contacting a shoulder portion of said cartridge case.

27. Training ammunition according to claim 26, wherein said rearwardly extending support member is a centrally disposed extension member tapering toward the rear.

28. Training ammunition according to claim 27, wherein said projectile is provided with a percussion fuze disposed therein and a primer pin for the percussion fuze is maintained in the region of the front end of said projectile by said cover hood means.

29. Training ammunition according to claim 28, wherein said projectile is provided with an axially extending recess at the front end thereof and having said primer pin disposed therein, said cover hood means maintaining said primer pin within the recess in the front end of said projectile.

30. Training ammunition according to claim 1, wherein said cover cap means includes a forwardly extending portion covering an axially extending portion of said projectile.

31. Training ammunition according to claim 30, wherein one of said projectile and said cover cap means is provided with recess means and the other of said projectile and said cover cap means is provided with projection means, said projection means engaging said recess means such that said cover cap means extends over the rear portion of said projectile in a form fitting manner.

32. Training ammunition according to claim 31, wherein said projectile is provided with said recess means and said cover cap means is provided with said projection means at said forwardly extending portion thereof.

33. Training ammunition according to claim 1, wherein said cover cap means detachably engages the axial extending rear portion of said projectile.

34. Training ammunition according to claim 33, wherein said cover cap means frictionally engages the projectile.

35. Training ammunition according to claim 1, wherein said cover cap means and said obturation means are disposed within said cartridge case.

* * * * *